US006324714B1

(12) United States Patent
Walz et al.

(10) Patent No.: US 6,324,714 B1
(45) Date of Patent: Dec. 4, 2001

(54) SWEEPING MACHINE

(75) Inventors: Jürgen Walz, Roigheim; Martin Kloepfer, Winnenden, both of (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/707,748

(22) Filed: Nov. 7, 2000

Related U.S. Application Data

(63) Continuation of application No. PCT/EP99/01576, filed on Mar. 11, 1999.

(30) Foreign Application Priority Data

May 8, 1998 (DE) ..... 198 20 628

(51) Int. Cl.[7] ..... A47L 5/30; A47L 11/19
(52) U.S. Cl. ..... 15/52.1; 15/50.3; 15/392
(58) Field of Search ..... 15/383, 389, 391, 15/392, 52.1, 50.3, 53.2

(56) References Cited

U.S. PATENT DOCUMENTS 1,613,396 * 1/1927 Keller .
3,892,003 * 7/1975 Peabody .
4,307,485 12/1981 Dessing, III .
4,484,372 11/1984 Pätzold et al. .
4,624,025 11/1986 Kaulig et al. .
4,914,777 * 4/1990 Cartellone .

FOREIGN PATENT DOCUMENTS 551 149 5/1932 (DE) .
31 00 372 8/1982 (DE) .
0 307 881 3/1989 (EP) .
2.071.158 9/1971 (FR) .
6 408 379 1/1966 (NL) .

* cited by examiner

*Primary Examiner*—Terrence R. Till
(74) *Attorney, Agent, or Firm*—Barry R. Lipsitz

(57) ABSTRACT

In order to simplify the construction of the mounting arrangement in a sweeping machine including a rotatably driven brushing roller which is rotatably mounted at each end in a frame and is driven at one end by a gear wheel which forms the mounting for the brushing roller at this end and the teeth of which engage in driver recesses in the brushing roller, it is proposed that the brushing roller be displaceable in an axial direction against the effect of a spring towards the gear wheel to such an extent that the mounting of the brushing roller at the end thereof remote from the gear wheel will disengage, and that the teeth of the gear wheel should engage in the driver recesses with so much play that the thus axially displaced brushing roller can be pivoted out from the region of the mounting by at least the radius of the brushing roller at said end remote from the gear wheel.

12 Claims, 4 Drawing Sheets

SWEEPING MACHINE

Figure 1:
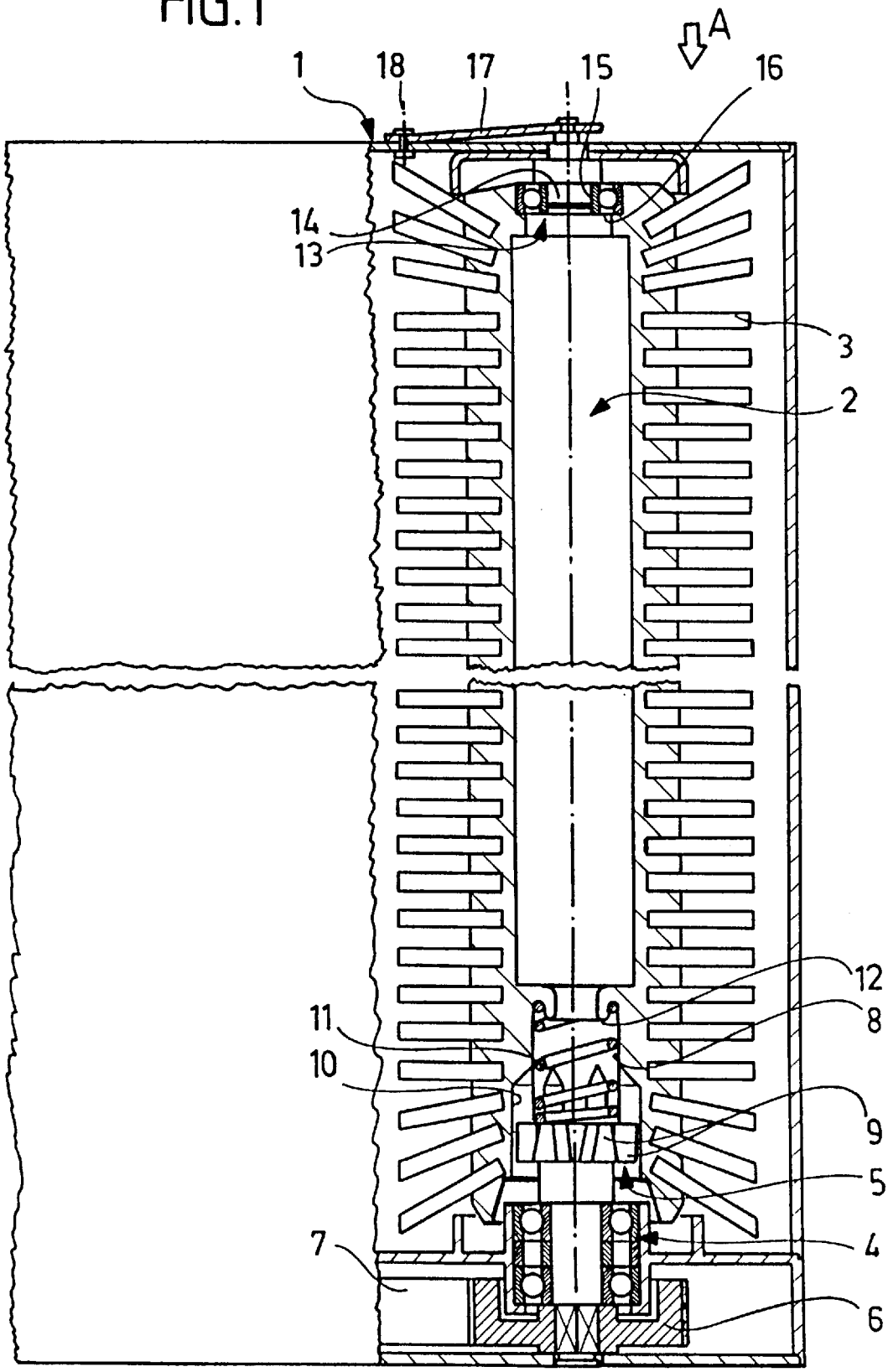

The present invention is a continuation to the subject matter disclosed in international application PCT/EP99/01576 of Mar. 11, 1999, the entire specification of which is incorporated herein by reference.

The invention relates to a sweeping machine including a rotatably driven brushing roller which is rotatably mounted at each end in a frame and is driven at one end by a gear wheel which forms the mounting for the brushing roller at this end and the teeth of which engage in driver recesses in the brushing roller.

In order to replace the brushing roller in sweeping machines of this type, it is necessary to construct the mounting at at least one end thereof in such a manner that it can be displaced in an axial direction and thus moved away from the end-face region of the brushing roller so that the brushing roller can be extracted in an axial direction from the other mounting. This makes it necessary for the mounting to be of relatively complex construction as it has to be designed such that it can be moved away from at least one end of the brushing roller.

The object of the invention is to design a sweeping machine of the above type in such a manner that the mounting arrangement can be simplified.

This object is achieved in that, in the case of a sweeping machine of the type described hereinabove, the brushing roller is displaceable in an axial direction against the effect of a spring towards the gear wheel to an extent sufficient for the mounting for the brushing roller at the end thereof remote from the gear wheel to disengage, and in that the teeth of the gear wheel engage in the driver recesses with so much play as to enable the thus axially displaced brushing roller to be pivoted out from the region of the mounting by at least the radius of the brushing roller at the end thereof remote from the gear wheel.

Such a design enables the mounting between the brushing roller and the end remote from the gear wheel to be released by displacing the brushing roller in an axial direction against a spring. Thereafter, one end of the brushing roller can be swung out relative to the mounting axis, namely, to such an extent, that the brushing roller can then be moved past this mounting in an axial direction. Consequently, it is no longer necessary to design the mounting itself to be removable. The essential thing here, is that the gear wheel should engage in the brushing roller with sufficient play for such a pivotal movement of the brushing roller to be easily possible, and that in this pivoted position, the brushing roller can be further withdrawn from the gear wheel. Surprisingly, it has been established that, despite this play between the gear wheel and the brushing roller, the side faces of the gear wheel will rest against the side faces of the driver openings in the operational state, and a perfect mounting for the brushing roller is thereby produced.

It is expedient if the spring is disposed in the interior of the brushing roller and if it is in the form of a compression spring which is supported on the brushing roller at one end and on the gear wheel at the other end. The spring is thereby accommodated in a protected manner within the brushing roller so that the mounting arrangement can be further simplified in this manner.

In a preferred embodiment, provision is made for the driver recesses to be in the form of axially extending open ended grooves in the inner wall of a central open-ended accommodating space in the brushing roller, which said space accommodates the gear wheel and possible also, the spring.

It is particularly advantageous if the width of the grooves continually decreases at least in a section adjoining their open end-faces. The greater width of the grooves at the end-face end simplifies the insertion of the brushing roller and the introduction of the teeth into the grooves.

A section of constant width preferably adjoins the section of decreasing width.

It is also expedient if the width of the teeth of the gear wheel decreases in a direction towards the brushing roller. This also simplifies the introduction of the teeth into the grooves.

The decreasing width of the grooves on the one hand, and the decreasing width of the teeth on the other also leads to the brushing roller being subjected to an axial force when the gear wheel rests on the side walls of the grooves, said force pressing the brushing roller against the mounting for the brushing roller at the end thereof remote from the gear wheel in the effective direction of the spring. This leads to a more secure form of mounting and, at the same time, the spring force can be reduced since one part of the pressure-force needed for the reliability of the mounting is produced by the axial component of force which results from the application of the gear wheel to the side wall of the groove. The replacement of the brushing roller is simplified by virtue of this weaker spring force, since the brushing roller then only has to be displaced against a less powerful spring.

Hereby, one should be aware that the axial forces, which are exerted on the brushing roller during the operation of the gear wheel may be relatively large, this being dependent on the rotational speed of the brushing roller. This may, for example, be in the general order of magnitude of 1000 revolutions per minute.

In a particularly preferred embodiment, provision is made for the inclination of the side faces of the grooves in the section of decreasing width on the one hand and the teeth of the gear wheel on the other to be the same relative to the longitudinal axis of the grooves. In operation, this design results in the side faces of the gear teeth making full area contact with the side faces of the grooves, and, due to the inclination of the contact faces relative to the longitudinal axis of the grooves, perfect centralisation of the gear wheel relative to the brushing roller is thereby achieved.

Provision may also be made for the side faces of the grooves to be inclined relative to the base of the groove such that the groove widens from the base to the accommodating space in the brushing roller.

The side faces of the teeth relative to the peripheral faces of the teeth may also be inclined such that the teeth become wider from the peripheral surface to the rotational axis.

Hereby, it is particularly advantageous if the inclination of the side faces of the grooves and that of the side faces of the teeth is substantially the same. In particular, provision may be made for the inclination of the side faces of the teeth and that of the grooves to slightly differ so that these side faces will then be in parallel when the gear wheel makes contact with the side faces. Since the teeth of the gear wheel engage in the grooves with play, the gear wheel must be rotated slightly from its mid position relative to the brushing roller in order to establish such contact, and the orientation of the side faces of the teeth thereby naturally alters in a corresponding manner. In order to ensure that a merely linear contact does not occur when the teeth rest on the side faces of the grooves, but rather, that full area contact be made, the side faces of the teeth and of the grooves are inclined relative to one another in correspondence with this small angle of rotation of the gear wheel, namely they do not extend exactly in parallel. If a tooth is located in a groove in said mid position, i.e. there is play with respect to both side faces of the groove, then the side faces of the groove and of the teeth are inclined very slightly relative to one another, so that, when the tooth rests on the side face of the corresponding groove, there will be full area contact and the side faces will then extend in parallel.

In operation, this leads to the brushing roller being centred relative to the gear wheel, and, moreover, the brushing roller will be pressed against the corresponding bearing, in the axial direction, in the manner described. In particular, it has been shown that this double inclination of the contact faces relative to the longitudinal axis of the grooves in the insertion direction of the teeth into the grooves on the one hand, and relative to the longitudinal mid plane of the grooves on the other, in the sense of a widening of the grooves towards the central accommodating space, enables the brushing roller to be mounted so as to be exactly centred and allows the torque to be transferred in play free manner when the machine is in operation, although in fact, the gear wheel and the grooves interengage with play so as to enable the lateral pivoting of the brushing roller and the withdrawal of the brushing roller when it is in its pivoted position.

Figure 2:
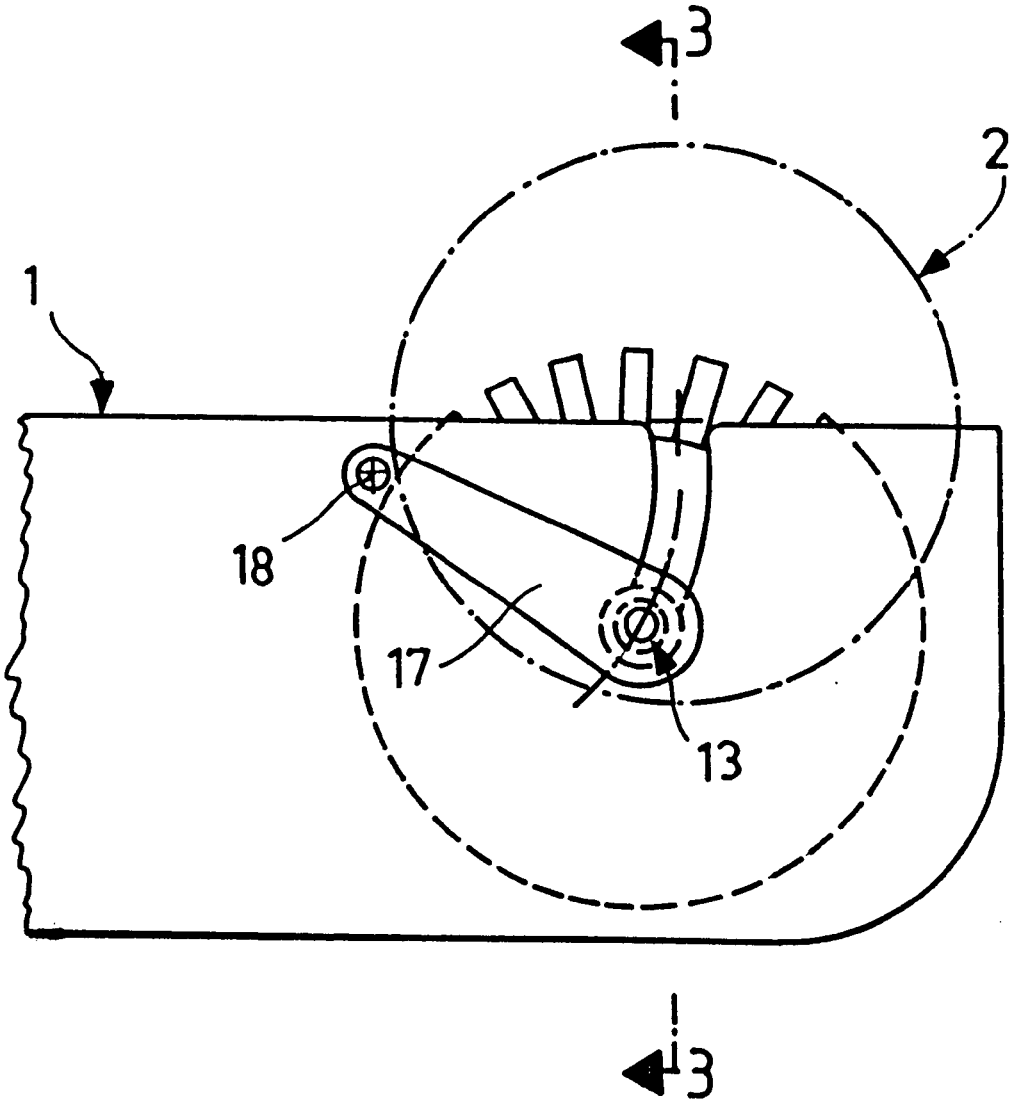
Figure 3:
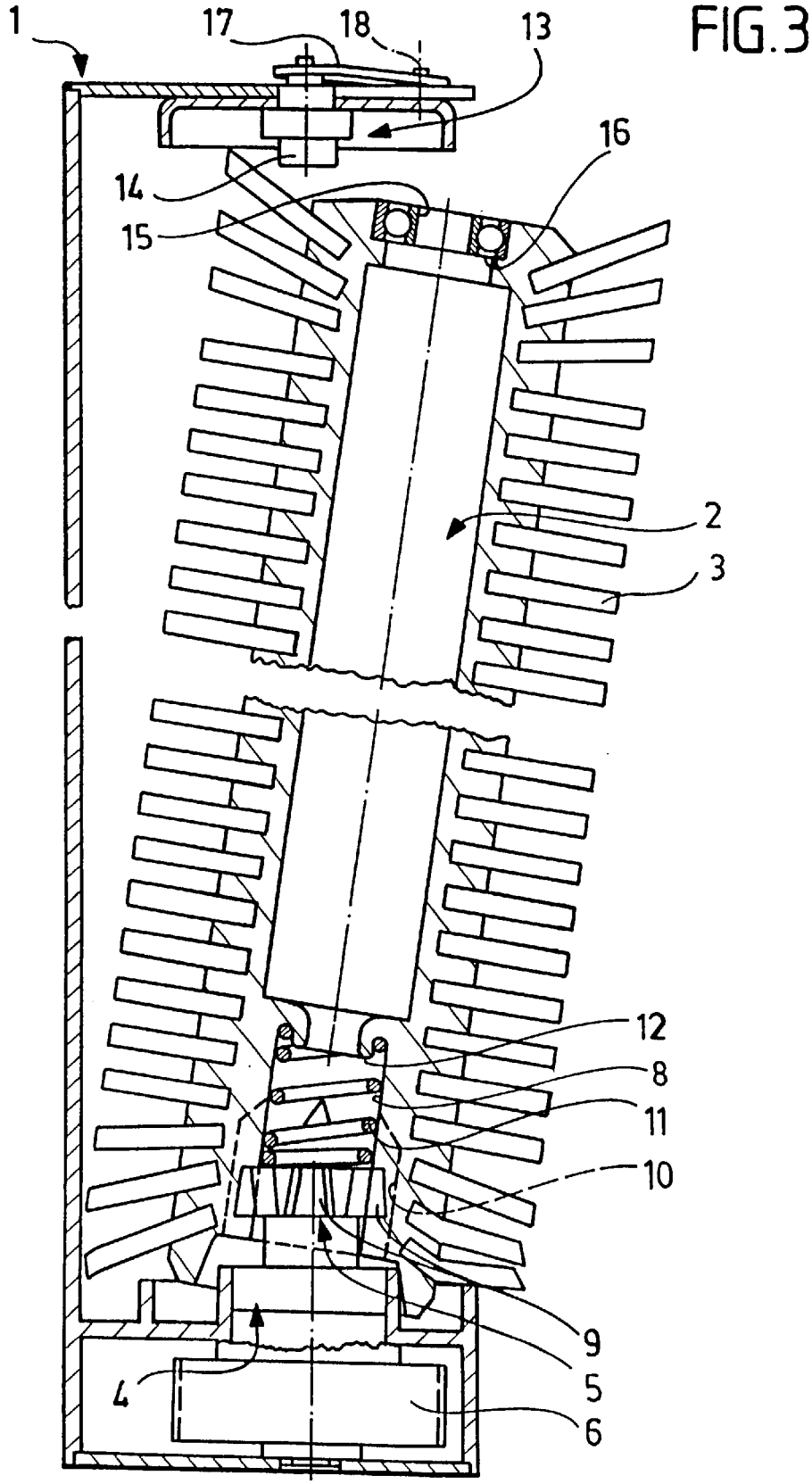
Figure 4:
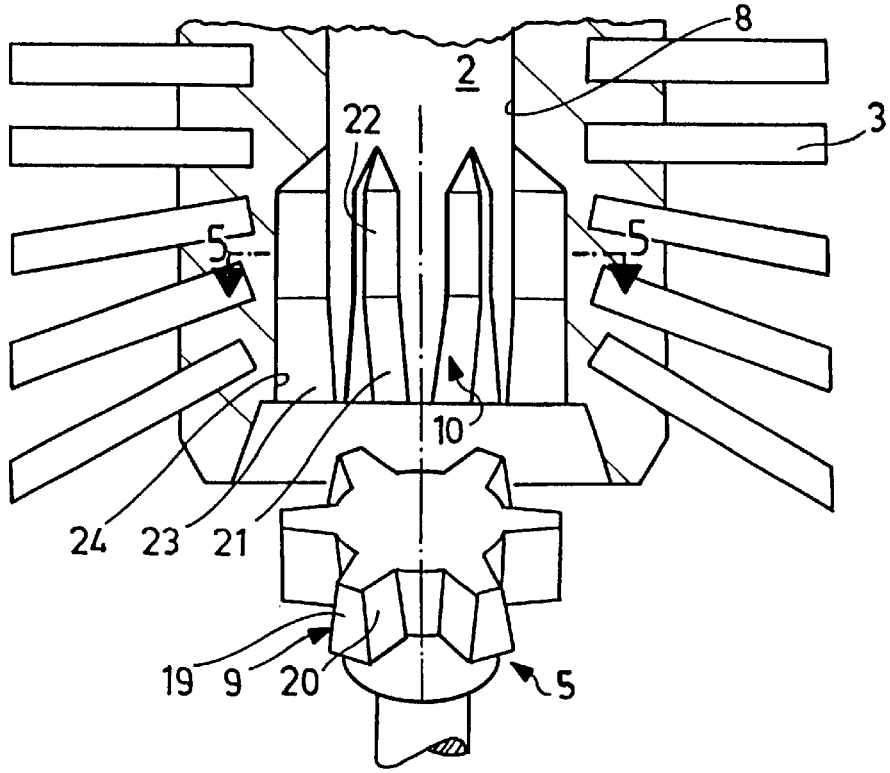
Figure 5:
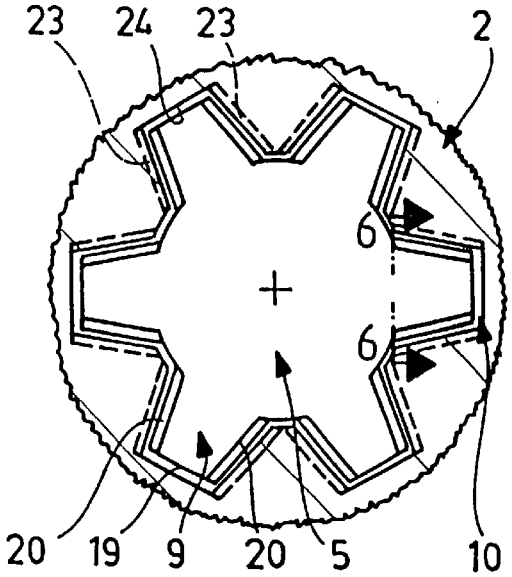

The following description of a preferred embodiment of the invention in conjunction with the drawing will serve to provide a more detailed explanation. Therein FIG. 1 shows a broken-away top view of a sweeping machine including a brushing roller which is mounted at both ends and is driven at one end by an engaging gear wheel;

FIG. 2 a top view of the sweeping machine in FIG. 1 in the direction of the arrow A wherein the sweeping machine is rotated through 180 degrees relative to its operational state;

FIG. 3 a sectional view along the line 3—3 in FIG. 2;

FIG. 4 an enlarged sectional view of the end region of the brushing roller in FIGS. 1 to 3 wherein the gear wheel has been withdrawn from the driver openings;

FIG. 5 a sectional view along the line 5—5 in FIG. 4 and

Figure 6:
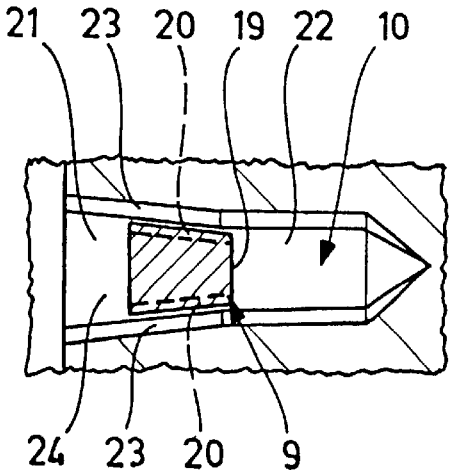

FIG. 6 a sectional view along the line 6—6 in FIG. 5.

The sweeping machine illustrated in the drawing comprises a frame 1 on which a cylindrical brushing roller 2 is rotatably mounted about its longitudinal axis and projects downwardly from the frame 1. The sweeping machine can be moved on rollers, which are not illustrated in the drawing, such that the bristles 3 of the brushing roller 2 rest on the floor that is to be cleaned and it functions by virtue of its own rotational movement when the sweeping machine is moved along.

A gear wheel 5 is mounted on the frame 1 at one end thereof in a bearing 4 that is fixed to the frame, said gear wheel projecting from the bearing 4 in an axial direction towards the interior of the frame 1 and being driven by a suitable driving device, for example, by means of a pulley 6 which is connected thereto for rotation therewith, whereby, for its part, the pulley can be set in motion by a drive belt 7.

The gear wheel 5 projects into a cylindrical central accommodating space 8 in the brushing roller 2 whereby the teeth 9 of the gear wheel 5 engage in axially parallel grooves 10 in the inner wall of the accommodating space 8. Furthermore, a spiral spring 11 is located in the accommodating space 8, said spring being supported at one end on the base 12 of the accommodating space 8 in the brushing roller 2 and on the gear wheel 5 at the other end in such a manner that the brushing roller 2 is displaced away from the gear wheel 5 in parallel with its longitudinal axis.

A further bearing 13 is disposed in the frame 1 at the end opposite to the bearing 4, said bearing 13 comprising a bearing pin 14 that projects into the central opening 15 of a bearing ring 16 which is centrally mounted on the end-face of the brushing roller 2 and is a ball bearing in the illustrated embodiment.

The bearing 13 itself is held on the free end of a pivot lever 17 which is mounted on the frame 1 about a pivotal axis 18 extending in parallel with the mounting pin 14. At this end of the frame 1, the brushing roller 2 is thereby pivotal out from the frame 1 to a greater or lesser extent, as is illustrated in FIG. 2. This serves, in particular, to permit the brushing roller 2 to adapt to any unevenness of the floor, and also serves to simplify the replacement of the brushing roller 2, as will be explained hereinafter.

The teeth 9 of the gear wheel 5 continuously decrease in width in a direction towards the brushing roller 2, whereas the width of the teeth 9 from its outer peripheral surface 19 towards the rotational axis of the gear wheel 5 increases. This thereby results in the plane side faces 20 of the teeth 9 exhibiting a double inclination (FIGS. 4 to 6).

The width of the grooves 10 continually decreases over a section 21 which adjoins the end-face of the brushing roller 2 in a direction towards the brushing roller 2, whereas, over a section 22 adjoined thereto, it remains the same (FIG. 6). The side faces 23 of the grooves 10 are inclined outwardly relative to the longitudinal mid plane of the grooves so that the width of the grooves 10 increases from the base 24 of the grooves 10 towards the accommodating space 8. This thereby results in a double inclination of the side faces 23 in the section 21 of the groove 10.

These inclinations are designed such that the side faces 23 of the grooves in the section 21 and the side faces 20 of the teeth 9 of the gear wheel 5 extend in parallel to one another, but nevertheless the width of the teeth 9 and the width of the grooves 10 are matched to one another such that the teeth 9 engage in the grooves 10 with play, i.e. said teeth are considerably narrower than the grooves 10.

In a manner not visible from the drawing, the inclination of the side faces 23 on the one hand and 20 on the other are selected such that the side faces 23 and 20 do not extend exactly in parallel when the teeth 9 of the gear wheel 5 are in the centre of the grooves 10, i.e. there is play with respect to the two side faces 23. In this position, said side faces 23 and 20 are slightly inclined to one another, namely approximately at an angle which corresponds to the angle through which the gear wheel rotates until the side faces 20 of the teeth 9 rest on the side faces 23 of the grooves 10. Here, we are concerned with a rotation of just a few degrees, whereby the side faces too are only inclined at a few degrees. However, this effect leads to these side faces being exactly parallel when the side faces 20 make contact with the side faces 23 and there is full area contact therebetween.

In normal operation, the side faces 20 of the teeth 9 rest on one side face 23 of the grooves 10 as soon as the gear wheel 5 is rotated. This is effected at one side only of the grooves and leads to the brushing roller 2 being centred relative to the gear wheel 5 by the inclination of the side faces 20 and 23. One thus achieves perfect mounting of the brushing roller 2 whereby the torque will be properly conveyed, although the teeth 9 engage in the grooves 10 with play.

This rotational connection is maintained in a similar manner when the position of the bearing 13 is altered by pivoting the pivotal lever 17, whereby, due to the play between the teeth 9 and the grooves 10, the torque can also be directly conveyed even when the brushing roller is slightly pivoted.

In order to replace the brushing roller 2, it is displaced against the force of the spiral spring 11 in an axial direction towards the gear wheel 5, namely, until the bearing pin 14 of the bearing 13 emerges from the opening 15 in the bearing ring 16. In this position, the brushing roller 2 can be pivoted downwards out of the frame 1 at its end adjacent to the bearing 13, namely, to an extent such that the brushing roller 2 can be withdrawn from the gear wheel 5 in an axial direction whilst by-passing the bearing 13. Such pivoting through a relatively large angle is easily possible since the teeth 9 of the gear wheel 5 engage in the grooves 10 with play and thus permit free axial displacement of the brushing roller 2 relative to the gear wheel 5 even in this pivoted position.

When inserting a new brushing roller 2, the teeth 9 of the gear wheel 5 can be fed into the grooves 10 extremely easily since they widen towards their inlet ends, and also because the teeth 9 become narrower in an inverse sense relative to the brushing roller 2. The brushing roller 2 is then pushed towards the gear wheel 5 against the effect of the spiral spring 11 until it is possible for the bearing ring 10 [sic] to pass laterally of the bearing pin 14 and then become aligned therewith. If one releases the brushing roller 2 in this position, then it will be displaced by the effect of the spiral spring 11 in a direction towards the bearing pin 14 until the latter reengages in the opening 15 and thus completes the mounting of the brushing roller 2. This mounting is maintained due to the effect of the spiral spring 11 during the entire operation of the machine.

It is thus possible to quickly replace the brushing roller 2 without using tools in the most simple of manners whereby the bearings 4 and 13 can remain in their usual position in the frame 1 so that overall one may observe a considerable simplification in the construction of the mounting.

What is claimed is:

1. A sweeping machine including a rotatably driven brushing roller which is rotatably mounted at each end in a frame and is driven at one end by a drive means engaging in driver recesses in the brushing roller and forming the mounting for the brushing roller at this end, whereby the brushing roller is displaceable in an axial direction against the effect of a spring towards the driver means to such an extent that the mounting of the brushing roller at the end remote from the driver means will disengage, in that the so axially displaced brushing roller is pivotal out from the region of the mounting by at least the radius of the brushing roller at its end remote from the drive means, wherein the drive means is in the form of a gear wheel whose teeth engage in the driver recesses with play for enabling the pivotal action of the brushing roller, whereby said driver recesses are in the form of axially extending open ended grooves in the inner wall of a central open-ended accommodating space in the brushing roller, which said space accommodates the gear wheel, and the width of the grooves continually decreases at least in a section adjoining their open end-faces.

2. A sweeping machine in accordance with claim 1, wherein:

the spring is disposed in the interior of the brushing roller, and the spring is a compression spring which is supported on the brushing roller at one end and on the gear wheel at the other end.

3. A sweeping machine in accordance with claim 2, wherein a section of constant width adjoins the section of decreasing width.

4. A sweeping machine in accordance with claim 3, wherein the width of the teeth of the gear wheel decreases in a direction towards the brushing roller.

5. A sweeping machine in accordance with claim 4, wherein the inclination of the side faces of the grooves in the section of decreasing width on the one hand and the side faces of the teeth of the gear wheel on the other is the same relative to the longitudinal axis of the grooves.

6. A sweeping machine in accordance with claim 1, wherein a section of constant width adjoins the section of decreasing width.

7. A sweeping machine in accordance with claim 6, wherein the width of the teeth of the gear wheel decreases in a direction towards the brushing roller.

8. A sweeping machine in accordance with claim 7, wherein the inclination of the side faces of the grooves in the section of decreasing width on the one hand and the side faces of the teeth of the gear wheel on the other is the same relative to the longitudinal axis of the grooves.

9. A sweeping machine in accordance with claim 1, wherein the side faces of the grooves are inclined relative to the base of the grooves such that the groove widens from the base up to the accommodating space in the brushing roller.

10. A sweeping machine in accordance with claim 9, wherein the side faces of the teeth are inclined relative to the peripheral face of the teeth such that the teeth become wider from the peripheral surface to the rotational axis.

11. A sweeping machine in accordance with claim 10, wherein the inclination of the side faces of the grooves and that of the side faces of the teeth is substantially the same.

12. A sweeping machine in accordance with claim 11, wherein the side faces of the teeth and the side faces of the grooves are inclined slightly relative to one another, such that the side faces of the teeth will then extend exactly parallel to the side faces of the grooves when the respective side faces are in contact with one another.

* * * * *